United States Patent [19]

Zinsmeyer

[11] Patent Number: 5,018,645

[45] Date of Patent: May 28, 1991

[54] AUTOMOTIVE FLUIDS DISPENSING AND BLENDING SYSTEM

[76] Inventor: Herbert G. Zinsmeyer, 5911 Bullard Dr., Austin, Tex. 78731

[21] Appl. No.: 472,236

[22] Filed: Jan. 30, 1990

[51] Int. Cl.[5] ..... B67D 5/30

[52] U.S. Cl. ..... 222/14; 222/26; 222/71; 222/132; 222/144.5; 222/145

[58] Field of Search ..... 222/14, 16, 26, 28, 222/71, 132, 144.5, 145, 608, 610, 173

[56] References Cited

U.S. PATENT DOCUMENTS

| | | | |
|---|---|---|---|
| 1,590,578 | 6/1926 | Harris et al. | 222/145 |
| 1,810,826 | 1/1931 | Gray | 222/173 |
| 3,130,871 | 4/1964 | Tye et al. . | |
| 3,179,291 | 4/1965 | Umbach et al. . | |
| 3,285,381 | 11/1966 | Robbins . | |
| 3,433,606 | 3/1969 | Moore et al. . | |
| 3,459,330 | 8/1969 | Bickford et al. . | |
| 3,469,741 | 9/1969 | Bickford et al. . | |
| 3,478,854 | 11/1969 | Dilger et al. . | |
| 3,478,856 | 11/1969 | Bly . | |
| 3,484,021 | 12/1969 | Bickford . | |
| 3,498,501 | 3/1970 | Robbins et al. . | |
| 3,510,630 | 5/1970 | Ryan et al. . | |
| 3,566,087 | 2/1971 | Dilger . | |
| 3,580,421 | 5/1971 | Bickford . | |
| 3,603,481 | 9/1971 | Dilger et al. . | |
| 3,612,393 | 10/1971 | Jones . | |
| 3,631,843 | 1/1972 | Yeiser . | |
| 3,633,000 | 1/1972 | Bickford . | |
| 3,639,735 | 2/1972 | Bickford . | |
| 3,641,536 | 2/1972 | Prospich . | |
| 3,678,253 | 7/1972 | Johnston . | |
| 3,688,291 | 8/1972 | Bateman . | |
| 3,689,749 | 9/1972 | Johnston . | |
| 3,696,236 | 10/1972 | Kus . | |
| 3,701,994 | 10/1972 | Bateman . | |
| 3,737,017 | 6/1973 | Bruno . | |
| 3,738,531 | 6/1973 | Mitchell . | |
| 3,749,283 | 7/1973 | Nelson . | |
| 3,756,630 | 9/1973 | Bickford . | |
| 3,799,310 | 2/1974 | Mims . | |
| 3,811,035 | 5/1974 | Brunone . | |
| 3,835,305 | 9/1974 | Kus . | |
| 3,845,848 | 11/1974 | Robbin . | |
| 3,878,377 | 4/1975 | Brunone . | |
| 3,904,009 | 9/1975 | Bateman . | |
| 3,927,800 | 12/1975 | Zinsmeyer et al. . | |
| 3,965,221 | 6/1976 | Englert et al. . | |
| 3,993,883 | 7/1971 | Robbins . | |
| 4,012,623 | 3/1977 | Fleischer . | |
| 4,033,833 | 7/1971 | Zinsmeyer et al. . | |
| 4,034,193 | 7/1972 | Jackson . | |
| 4,049,159 | 9/1977 | Todd et al. . | |
| 4,074,356 | 2/1978 | Schiller et al. . | |
| 4,107,992 | 8/1978 | Bateman et al. . | |
| 4,131,215 | 12/1978 | Hansel | 222/26 |
| 4,136,573 | 1/1979 | Smilgys et al. . | |
| 4,186,381 | 1/1980 | Fleischer et al. . | |
| 4,223,807 | 9/1980 | Caswell et al. . | |
| 4,247,899 | 1/1981 | Schiller et al. . | |
| 4,250,550 | 2/1981 | Fleischer . | |
| 4,253,436 | 3/1981 | Dudrey . | |
| 4,286,550 | 9/1981 | Lewis . | |
| 4,292,506 | 9/1981 | Devanney . | |
| 4,331,121 | 5/1982 | Stokes . | |
| 4,347,435 | 8/1982 | Evans et al. . | |
| 4,360,877 | 11/1982 | Langston et al. . | |
| 4,417,134 | 11/1983 | Garland . | |
| 4,418,273 | 11/1983 | Devanney . | |
| 4,426,574 | 11/1984 | Smilgys . | |
| 4,568,248 | 2/1986 | Harders . | |
| 4,576,312 | 3/1986 | Schwick, Jr. . | |
| 4,727,827 | 3/1988 | Hoffman et al. . | |
| 4,880,144 | 7/1989 | Shea | 222/608 |

*Primary Examiner*—Andres Kashnikow
*Assistant Examiner*—Lesley D. Morris
*Attorney, Agent, or Firm*—Joseph F. Long

[57] ABSTRACT

An automotive fluids dispensing and blending system wherein a customer may select various fuel additives such as octane enhancers, fuel injector cleaners, varnish dissolvers, compounds to free-up piston rings, etc., all choices of which may be automatically blended with the selected fuel as the fuel is being dispensed normally into the vehicle fuel tank. The system also allows the customer to select and dispense various engine oils and oil additives, antifreeze solutions, windshield washer fluid, power steering fluid, and other automotive fluids directly into the vehicle using provided lines, nozzles and controls. All sales transactions are displayed to the customer and station operator for purposes of payment, and all sales transaction data is recorded and stored.

36 Claims, 6 Drawing Sheets

AUTOMOTIVE FLUIDS DISPENSING AND BLENDING SYSTEM

BACKGROUND OF THE INVENTION

This invention relates to the automated dispensing and simultaneous custom blending of additives into fuels, such as gasoline and diesel fuel, while those fuels are being dispensed into vehicle fuel tanks, such as automobiles and trucks. It further encompasses automatic dispensing, with choice by the customer, of motor oil, motor oil additives, anti-freeze solution, power steering fluid, windshield washer fluid, etc. This system is designed to be installed totally or in increments. Logical increments would be a first portion to cover fuel additive addition and blending; a second part to cover a choice of multiple grades of oil and a choice of multiple different oil additives and a third part would handle dispensation of needed liquids for automobile servicing that would include anti-freeze solution, power steering fluid, transmission oil, windshield wiper fluid, etc.

The use of additives in automotive fuels has been commonplace for many years. These additives have been formulated by chemical and petroleum companies to enhance the basic fuels and improve their characteristics in many ways. These especially include additives that inhibit oxidation, rust, and formation of gum. Certainly among the most common additives are the lead compounds used for increasing the octane rating (anti-knock quality) of gasoline needed by high compression engines. In more recent years, numerous new additives have been developed. Some of these are for improving the octane without the use of lead because of the air pollutants that lead produces, and because of the damage lead products do to the catalytic convertors which are now used on automotive engines to reduce air pollution. Others are detergents for keeping carburetors and fuel injectors clean, and there are deposit modifiers for keeping components clean and preventing/removing carbon and other deposits from accumulating on critical engine components. There are additives that prevent freezing of water accumulations in fuel tank and lines in cold weather, and upper cylinder lubricants. There are even additives that offset the harmful effects of other additives. As higher technology engines have been developed, in the USA as well as in Europe and Japan, the need for fuel additives has become ever more critical. The additives business is on a rapid increase as oil companies, auto service departments and motorists strive to meet the needs of the new engines, and to minimize expensive repairs.

Historically, additives have been blended into the fuel at various stages. Additives needed in all gasolines are added at the refinery. Others important to the pipeline (anti-rust, for example) are added at the pipeline entry. Others that are more specifically required by the marketer and his public customers are added selectively at the terminals and bulk plants in accordance with the specifications of the individual gasoline marketer. Major oil companies often provide and promote additives in their gasoline to encourage brand allegiance, and this is especially true of their costly premium grades. On the opposite end of the spectrum, many "unbranded" gasolines have no additional additives at all.

Motorists who need, or wish, to use enhanced fuels in their automobiles must buy expensive premium brands in the hopes of getting what their engines need. Their only other alternative is to shop for additives in retail outlets, such as auto parts stores, and with messy inconvenience, add it to the fuel tank when they next buy fuel.

It will be helpful to review the service station and convenience store environment into which this invention will enter. In the past 20 years., the retail gasoline service station operations have changed rather drastically from the traditional stations where the customer and their autos were attended by station employees, and where there usually were service bays for doing lubrication and minor auto repairs. The conversion to mostly self-serve stations, and convenience stores that sell gasoline, have left relatively few of the old style stations in operation, especially in the urban areas. These new stations rely very successfully on the customer serving himself, resulting in time and monetary savings for all involved. It is noteworthy that the general public has adapted well to self-service, even though they are dealing with a very hazardous and noxious material In order for this to happen, very specialized equipment had to be developed for customer convenience and for safely controlling the self-serve dispensing of gasoline and diesel fuels. The attitudes of the motoring public had to change drastically in order to accept the self-serve mode of station operation, and it did not happen overnight. Yet, in looking back, it is just an extension of the general trend toward self-service that had already taken place in supermarkets and most other retail outlets. There has been a conversion in the attitudes of most consumers toward the preference to do it himself, exercising his inherent obsession for freedom of choice, and saving time and money in the process.

This invention provides a logical extension for the established trend where the general public can serve itself with the products that it needs and wants, with a saving of time, and probably money as well. In this case it is for the easy choice by motorists to purchase and automatically blend fuel additives for their expensive automobile engines as they determine are required (a variable over the life of the automobile), and to conveniently purchase and dispense directly into their automobile the various other automotive fluids as desired. These additives can include octane boosters (anti-knock agents), detergents, deposit modifiers, carbon removers, anti-icing, upper cylinder lubricants, etc. It is widely written by experts in the industry that the newer high technology engines require ever more additives to maintain the critical precision, meet their cleanliness needs and octane rating. It is also recognized that these additives may not be rigorously provided by the oil companies and the various gasoline marketers to meet everyone's needs. Similarly the customer may choose and purchase desired motor oil, any one of the various oil additives such as those to dissolve sludge, free up sticking valves, piston rings, etc. And in the same manner a customer may simply add the various other liquids such as anti-freeze solution, windshield wiper fluid, etc., and buy only the needed quantity.

There are several patents in this general field. We have considered the following patents:

| Patent No. | Inventor(s) | Issue Date |
|---|---|---|
| 3.316 844 | Valle, et al | 5/2/1967 |
| 4,131,215 | Hansel | 12/26/1978 |
| 4,276,997 | Ambler | 7/7/1981 |
| 4,596,277 | Djordjevic | 6/24/1986 |

-continued

| Patent No. | Inventor(s) | Issue Date |
|---|---|---|
| 4,714,087 | Jones | 12/22/1987 |

Of the cited references the Hansel patent assigned to Sun Oil in December 1978 is close to some aspects of our invention. Hansel arrangement has not been a commercial success as evidenced by the issue date and the fact that none are known to be in use. Major differences lie in lack of customer choice, meeting of regulatory requirements, and ease of use as compared with our invention. Our invention allows the customer to choose additives for fuel, choice of and dispensing of products in amounts as low as one ounce or less, choice and dispensing of oil additives and similar purchase of needed quantities of other fluids such as anti-freeze, windshield wiper fluid, etc. This is in contrast with one additive for fuel only in a single mix ratio, and without independent calculations and display, and modern self-serve controls and display as used in our invention.

Further, our invention covers use of an additive nozzle wherein control and display is at the point of addition for customer use in purchasing such fluids as oil, windshield wiper fluid, anti-freeze solution and a wide range of automotive fluids. These products may be purchased in the amounts needed rather than in cans as presently sold, with the volume and monetary amount displayed continuously to the customer as it is being dispensed.

SUMMARY OF THE INVENTION

The overall objective of this invention is to allow a customer to conveniently select, dispense, blend and purchase only the amount desired of each of the additives and other fluids used in a modern day automobile or truck.

A further objective of the invention is to simplify the work of the service station operator and to allow the service station operator to purchase, in bulk form, the various fluids such as fuel additives, oil, oil additives, windshield wiper fluid, anti-freeze solution, etc., thus allowing a lower price to the customer.

Another objective of the invention is to allow the customer a reasonable choice of additives and other automotive fluids as described and also allow the customer to buy only the amount needed. For example, the customer may need a fraction of a quart of oil; a fractional part of a gallon of anti-freeze/water solution, etc. This invention allows the customer to purchase such quantities while monitoring the sales display and allows the service station operator to directly read the same amounts and costs from an operator console. This may be a separate console or the functions may be integrated in the present electronic console normally found in most service stations. The invention may be described as a Multiple Additive Dispenser with computer control and calculation and display to aid both the customer and service station operator.

The Multiple Additive Dispenser comprises a dispenser housing that would normally be close to or between gasoline dispensing pumps. This dispenser housing may house a computer type control unit that communicates with:

a) a first set of switches that allows a customer to choose one or more of a number of fuel additives and to choose either a set volumetric amount or an amount proportioned to fuel being pumped and shown as a percent of an established normal;
b) a fuel flowmeter in the fuel dispensing line;
c) a pump and flow measuring device for each of various fuel additives storage tanks;
d) automatic distribution valves with lines, manifolds, and injector nozzles to direct the flow of selected fuel additives to the customer selected fueling line or nozzle of the adjacent fuel pump or dispenser for blending with the fuel as it is being dispensed;
e) a second set of switches that allows the customer to choose one or more of a number of types of oil and to choose any desired amount in fluid measure starting as low as less than one pint or dispense until sufficient has been taken;
f) a pump and flow measuring device for each of the different types of oil with distribution lines and nozzles;
g) a third set of switches that allows a customer to choose one or more of a number of different oil additives and to choose any amount in volumetric units or an amount expressed as percentage of an established normal oil additive use;
h) a pump and flow measuring device for each of the different types of oil additives with distribution lines, manifolds and injector nozzles to direct flow directly to the automobile or to blend with oil being dispensed;
i) a fourth set of switches that allows a customer to select one or more of a number of other automotive fluids such as anti-freeze/water solution, windshield wiper fluid, etc., to be dispensed directly into the vehicle from bulk storage;
j) a switch on a dispensing nozzle which may also have a display with one nozzle used for each of a number of automotive fluids including power steering fluid, anti-freeze-water solution, windshield wiper fluid, etc;
k) a pump and flow measuring device for each of the various fluids in the group;
l) control, computing, and display means for supporting sale of each product; and
m) with an operator console or console for use by the operator.

With proper programming for the operator console and the computer type controller electronic communication as described allows the customer:

(1) to tell the operator the amount of fuel, fuel additives, oil, oil additives and/or any of the miscellaneous fluids he desired and allows the operator to key into the console and control the amount to be dispensed or simply authorize the dispenser to be used;
(2) to use either first, second, third or fourth set of switches to choose fuel additives, oil, oil additives and other automotive fluids and pay before or after dispensing;
(3) to use the regular fueling hoses and nozzles with an associated fuel dispenser that is equipped to allow automatic blending of the selected additive with the selected fuel;
(4) to use the dispensing nozzles, with or without nozzle display, to dispense one or more of the following: power steering fluid, anti-freeze water solution, transmission fluid, windshield fluid, etc., and to pay before or after dispensing.

With input from the various switches, pumps and flowmeters as described, the controller may also output to display unit, cost, volume dispensed, and sale amount for each of the fluids dispensed. Communication between the operator console and controller allows operator input to display all costs, amounts and totals on the operator console, and to include the respective sales data with the recorded totals.

In some embodiments of the invention the functions of the operator console and controller may be integrated with existing types of electronic control, display, etc., normally found in most service stations. Thus in this manner, control of fuel flow as presently done would be included with the control of the additives and other automotive fluids as disclosed herein.

DESCRIPTION OF PREFERRED EMBODIMENTS

We will describe the preferred embodiment along with possible variations by a detailed description of the drawings.

Figure 1:
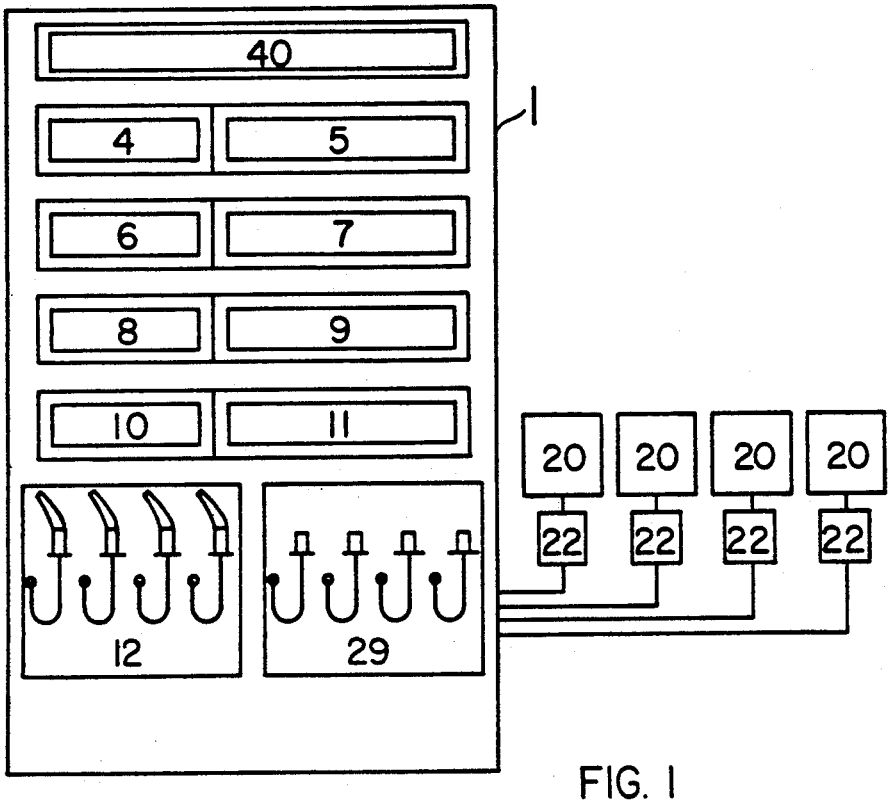
FIG. 1 shows a front view of a weather proof cabinet that would normally be located close to fuel dispensing pumps. This cabinet contains various switches to allow a customer to choose additives, oils and other fluids normally needed in a vehicle and may also include dispensing lines with nozzles for some fluids. A controller may also be located in this cabinet. Also shown are storage, pump out and flow measuring means for various fluids such as anti-freeze and windshield wiper fluids.

In FIG. 1 we show a weatherproof housing 1 that contains a first group of switches 4 that allows a motorist to choose one or more fuel additives from a number of available fuel additives and to choose the amount in fluid measure or as a percent of normal use. When percent of normal is chosen, the controller, as later described, acts to dispense the chosen additive in proper ratio to fuel dispensed. Display panel 5 displays volume and cost to the customer of fluids dispensed.

A second group of switches 6 allows a consumer to choose an amount of one or more of the available oils. Names, grades, etc., of each available oil will be displayed. Amounts such as decimal fractions of a quart may be chosen. Rather frequently, a motorist needs other than whole quarts to achieve the proper crankcase level. Display panel 7 displays volume and cost of oil dispensed.

A third group of switches 8 allows a consumer to choose an amount of one or more of the oil additives available. The system would normally be set up to have a number of choices of types of oil additives. Display panel 9 displays cost and volume of oil additives dispensed.

A fourth group of switches 10 allows a consumer to choose from a variety of other automotive fluids. A display panel 11 may display volume and cost of fluid dispensed.

Shown at the bottom of FIG. 1, item 12 depicts in general dispensing hoses and nozzles, each with a control switch, for dispensing a variety of other automotive fluids such as an anti-freeze/water solution, unblended fuel additive, power steering fluid, windshield wiper fluid, transmission oil and additives, etc. Nozzles of 12 may be of any of the types 32, 29 or 75 as later described. Hoses and nozzles 29 are a special plug-in type used for blending fuel additives also described under FIG. 10. The specific fluids being dispensed through these 12 and 29 type hoses and nozzles may be varied depending upon sales demand, storage, etc. We have shown a total of four each but either more or less may be used.

Figure 8:
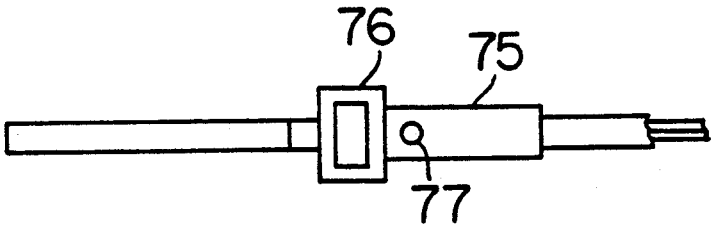
FIG. 8 shows a top view of a display type dispensing nozzle wherein cost and amount of fluid dispensed is displayed and a manual switch controls flow through communication with the controller.
Figure 9:
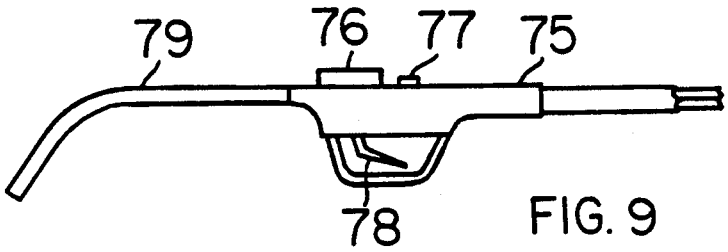
FIG. 9 shows a sideview of the display type dispensing nozzle.

In some embodiments a display type nozzle as shown in FIG. 8 and 9 may be used in place of or to supplement display panels 5, 7, 9 and 11.

The weather proof housing 1 may also contain a computer type controller 40; with normal cable connections the computer controller 40 could also be housed in the service station office. If the controller 40 is housed in the weatherproof housing 1 a normal climate control system to prevent excessive heat or humidity may be incorporated.

Storage for the various fluids indicated by numbers 20 may be in the same cabinet 1 or remotely located depending upon volumes required The number 22 indicates a pressuring and flow measuring means which could be located in cabinet 1 or remotely located. This could be a metering pump communicating with and controlled by controller 40 or could be any one of several types of pumps with any of several types of in-line flowmeter similarly communicating with controller 40.

Figure 2:
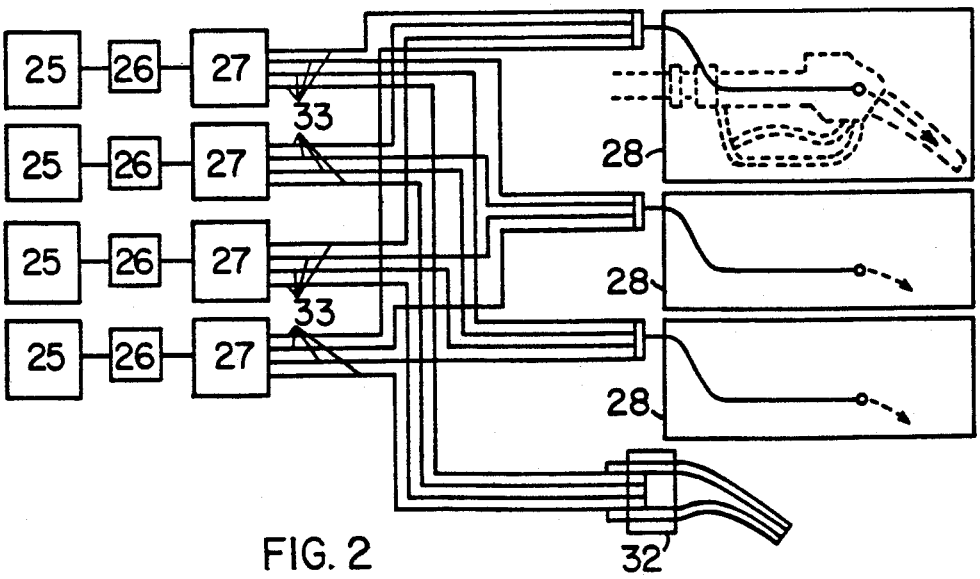
FIG. 2 shows additive storage, pump out and flow measuring means, and distributor valves to allow pumping measured fuel additives of the customers choice to a fuel dispensing nozzle.

In FIG. 2 we show a number of different fuel additives, each in a storage tank 25 with each storage tank leading to a pressuring and flow measuring means 26 that could be a metering pump in a preferred embodiment or any of several other means including air pressure in the top of the tank forcing the additive out through a control valve and any one of several flowmeters. Any type of pressuring and flow measuring means would communicate with and be controlled by controller 40. We also show a distributor valve 27 that directs each additive to any one of several fuel dispensing nozzles 28 and 32 thru lines 33. As will be seen from FIG. 12 this preferred type distributor valve 27 may be constructed as a single unit to direct flow from multiple additive pumps 26 to a multiplicity of fuel dispensing nozzles 28 and 32. In another embodiment lines from each pressuring and measuring means could be headered together with a solenoid valve in each line leading to the various dispensing valves responding to the controller to direct flow to the customer selected dispensing nozzles 28 and/or 32.

Figure 3:
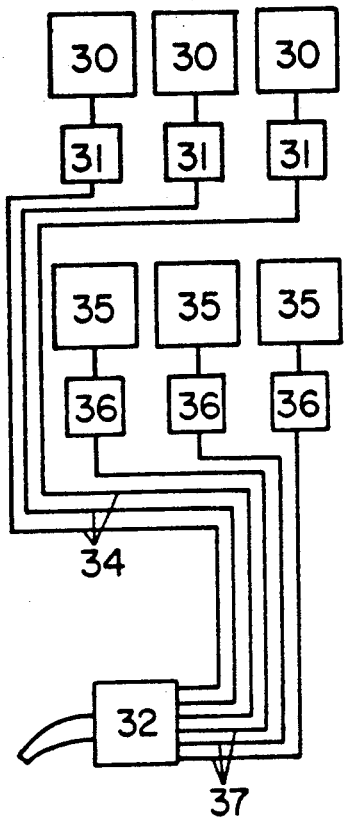
FIG. 3 shows (1) a multiplicity of oil storage units with pump-out and flow measurement means to allow a customer to put measured amounts of oils of his choice in his vehicle and (2) storage, pump out and flow measuring means for additives normally used with oil such as those designed to free sticky valves, sticky rings, etc. As shown, these may be dispensed through the same nozzle as oil.

In FIG. 3 we show storage tanks 35 for a multiplicity of types of crankcase oil, three being shown for simplicity of the drawing. Each of storage tank 35 would be equipped with pressuring and flow measuring devices 36 such as a metering pump, in a preferred embodiment, leading to an oil dispensing nozzle 38 thru lines 37. In other embodiments centrifugal or other type pumps with flow measuring instrumentation would be used. In all embodiments the pressuring and flow measuring devices communicate electronically with controller 40, FIG. 1, and are directed and controlled thereby.

In FIG. 3 we also show storage tanks 30 for a multiplicity of differing oil additives; each tank being equipped with a pressuring and flow measuring means 31 leading to a dispensing nozzle 38 thru lines 34. The pressuring and flow measuring means may be as simple as a metering pump in a preferred embodiment, or other type pumps and meters. With all embodiments the pressuring and flow measuring means would communicate electronically with controller 40 and be directed and controlled thereby.

Figure 4:
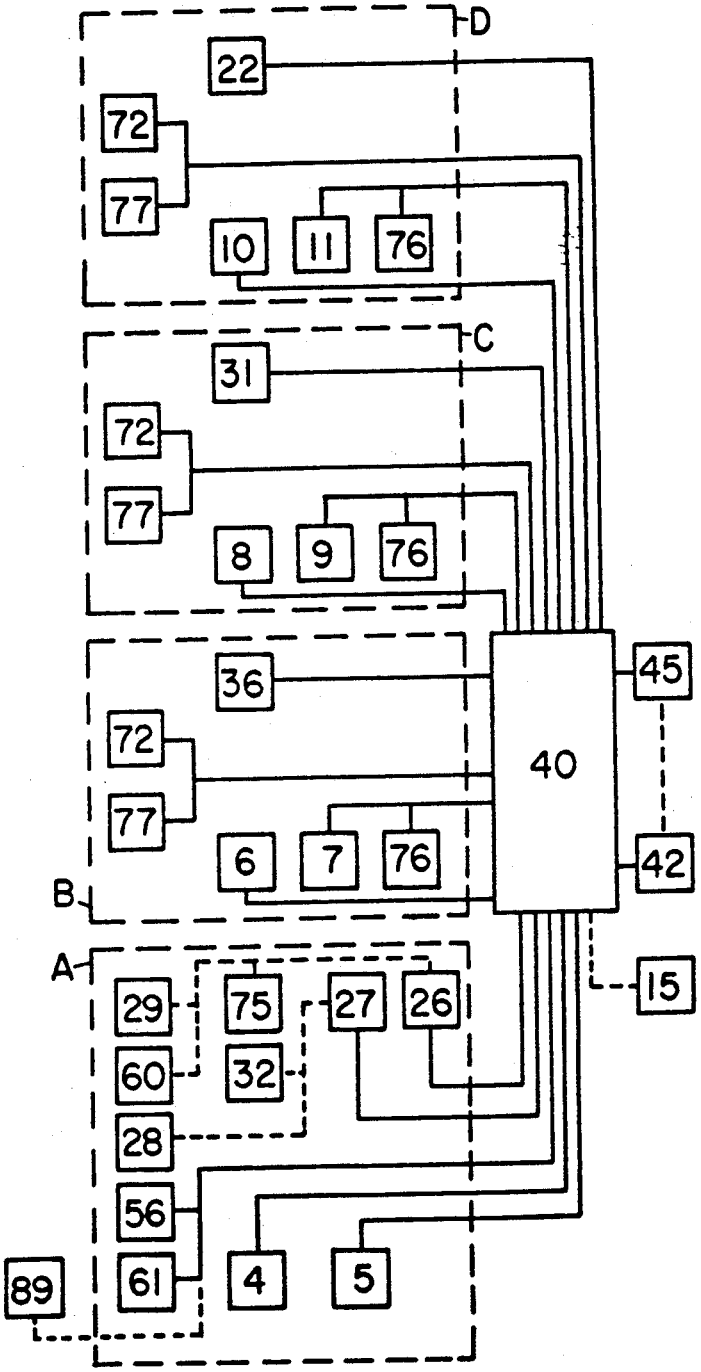
FIG. 4 is a diagrammatic representation of electronic circuitry showing communication of a controller of a computer type with the various flow sensing and measuring units, with the switches that allow a customer to choose type and amount of various additives, with cost and display totals and with an operator console to allow displays and control for use of the station operator. As shown both the controller and console functions may be partially or totally integrated with present normally used electronic units.

In FIG. 4 we show a diagrammatic representation of the electronic communication and control system and associated nozzles 28, 29, 32, 75 and blending device 60; all later discussed. For ease of understanding we show block A in dotted lines to indicate electronic communication between the functional elements of the fuel additive dispenser and controller 40. The controller 40, in turn, may communicate with an operator console 45 which may display, store and print out data. Block B is similar but for oil sales; block C is similar but covers oil additives and block D covers all other automotive fluids.

Figure 5:
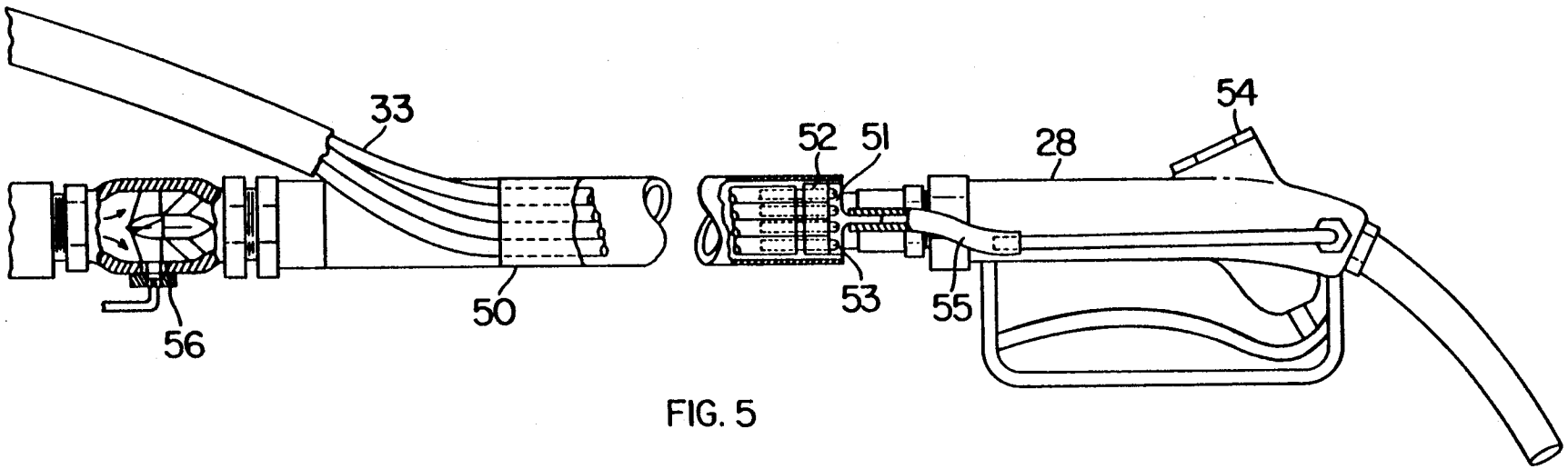
FIG. 5 shows an auxiliary fuel flow measuring device, additive distribution lines, and one specialized type fuel dispensing nozzle to allow blending of a chosen fuel additive as fuel is dispensed.
Figure 6:
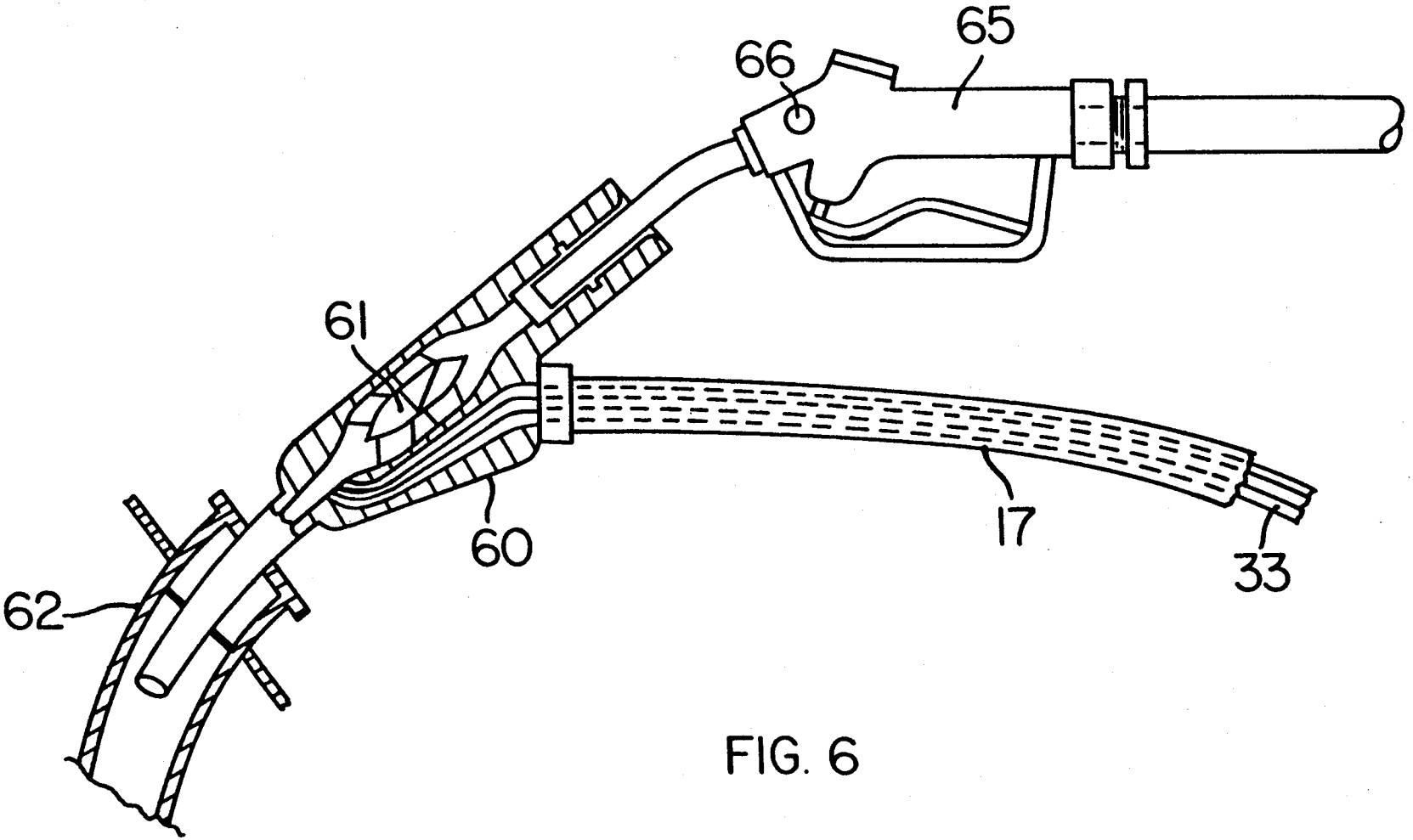
FIG. 6 shows a fuel additive blending device with flow measurement and blending taking place between the fueling nozzle and the fuel filler pipe. Also shown in the fueling nozzle is a normally closed plug-in port that allows using a single additive line with a valve that opens when plugged into the plug-in port to blend in the nozzle without the use of the additional blending device.

In one preferred embodiment a specialized type programmable computer hereinafter called a controller 40 is used. A group of switches 4, FIG. 1, allow a consumer to choose one or more fuel additives and to choose a desired fluid volume or cost amount of the additive or an amount of additive indicated as percent of an established normal additive/fuel mix ratio. For fuel additive dispensing and blending we show electronic communication with controller 40 as follows:

(1) a fuel flowmeter 56, FIG. 5 or a fuel flowmeter 61, FIG. 6, or a conventional fuel flowmeter existing in the fuel dispenser 89, measuring flow to a blending type fuel dispenser nozzle 28 or blending device 60, FIG. 6;

(2) a pressuring and flow measuring means 26 in lines from fuel additive storage tanks 25, FIG. 2;

(3) a distributor valve 27 in lines leading from pressuring and measuring means to a multiplicity of fuel dispensing nozzles 28, non-blending additive nozzle 32 and separate blending unit 60; and, in some embodiments (4) an operator console 45, which is a special type programmable computer—display unit that can remotely control fuel and oil additives, and oil and other automotive fluid dispensing. In still other embodiments functions of operator console 45 and controller 40 may communicate with or be partially or totally integrated in electronic controls 42 such as are currently in use in some service stations.

(5) a fuel dispenser computer 15, which in some embodiments may be controlled by the controller 40.

With electronic communication between the controller 40, operator console 45 and fuel additive dispensing equipment as listed, the fuel dispensing—fuel additive system may operate as follows:

First, a customer may prepay, or preset, by having the attendant key-in desired amounts of fuel and fuel additive to the operator console 45. The attendant will then send those instructions to the controller 40 via the communication link with the operator console 45. The display 5 will show additive costs and volume amounts as the equipment as described will operate to dispense and limit dispensation to the proper quantities as the fuel is being dispensed normally.

Second, in a post pay mode, a customer may first have the operator authorize use of the dispenser, then push the proper switches in switch group 4 to choose the fuel additive and amount of additive desired and then put fuel in his tank in the normal manner. In any of the above prepay, preset or postpay modes, the equipment will function to dispense thru pressuring and measuring devices 26 and distributor valve 27 the selected additives to be dispensed and/or blended with the selected fuel in the selected proportions as the fuel flow is detected and measured by the fuel flowmeter 56, 61, or 89 in the fuel line that is being used. The cost and amount of fuel dispensed will be displayed on the fuel pump and on the normally existing operator's fuel control console in the usual way; the cost and amount of additive dispensed will be displayed on panel 5, and in embodiments having an operator console 45, the cost and amount of fuel additives may be displayed upon the operator console 45 upon command from the operator. In the preferred embodiment the distributor valve 27 automatically distributes the fuel additive either to the customer selected fuel blending nozzle 28, FIG. 2 and FIG. 5 or to a nozzle 32, FIG. 7 wherein additives may be dispensed to a container or directly to a consumer's tank. In other embodiments the additives may be manually distributed directly from the pressuring and measuring means 26, FIG. 2 to a to plug-in nozzle 29, FIG. 10, that may plug-in to a normally closed port 66, FIG. 6, on an otherwise unmodified customer selected fuel nozzle 65, FIG. 6, or to a blending device 60, FIG. 6, or a nozzle 75, FIGS. 8 and 9, in which cases the distributor valve 27 can be eliminated.

In some embodiments, the selection of fuel and quantity might be made from the additive dispenser as another automotive fluid, in which case the controller 40 communicates with fuel dispenser 15.

Similarly, as shown in Block B, a customer may choose one of the available type oils and desired amount by activating switches in switch group 6, FIG. 1. These switches are properly labeled to allow this choice. The customer then positions one of dispensing nozzles and activates a nozzle switch 72 or 77. Such nozzle and switch can be of the combination oil and oil additive and fuel additive type, 32 and switch 72, or the individual type, 75 and switch 77, as shown on FIGS. 7, 8 and 9. With electronic communication between controller 40, switches 6, nozzle switches 72 or 77 and pressuring and flow measuring means 36, the system will respond by dispensing the selected amount and stopping. An undefined amount may be selected on switch group 6 and the system will respond by delivering an unlimited amount while the nozzle switch is being depressed, allowing the customer to add any amount desired while monitoring the delivered amounts on the displays provided. The above mentioned nozzle types 32 and 75 may include a display 76 for customer convenience, and a level activator 78 for switches 72 and 77.

Further, the system as described reacts to display on housing 1 the unit price, cost, and amount of oil dispensed on panel 7. Also, upon operator command, the unit price, cost and amount of oil dispensed will be displayed upon the operator console 45 in embodiments with an operator console. If a customer wishes to prepay, the operator may key in proper commands on the operator console 45 to limit the amount of oil dispensed as well as to display on panel 7 cost and amount of the delivery.

In the same manner, as indicated in Block C, a customer may select the oil additive and amount of the additive desired by using proper switches in switch group 8. After positioning the oil dispensing nozzle 32 or 75 the customer pushes a nozzle switch 72 or 77, or when provided, switch lever 78 on 75, FIGS. 7, 8 and 9 and with electronic communication between controller 40 and pressuring and measuring means 31, the system reacts to deliver the quantity of oil additive specified. The customer can choose an undefined amount and the quantity dispensed will depend upon the control by nozzle switch 72 or 77. With display type nozzles FIGS. 8 and 9 the cost and amount will be displayed on the nozzle panel 76.

Further, the system displays cost and amount dispensed on panel 9, and in embodiments with operator console 45 on the operator console display The customer may prepay and the operator using console 45 may limit amount dispensed as described for oil and fuel additives.

In the same manner, as shown in Block D, a customer may also purchase any of a group of other fluids commonly needed for a vehicle. This group, called other automotive fluids hereafter, would include windshield wiper fluid, power steering fluid, transmission fluid, anti-freeze or anti-freeze/water solution, and additives for transmission fluid. It may also include fuel additives to be dispensed in a non-blending mode, through a nozzles 32 or 75 as shown on FIGS. 7, 8 and 9. Other fluids, such as brake fluid, would come within the spirit and purpose of this invention. Such selection is made by the customer by using proper switches in switch group 10. Since the customer often would not know the exact amounts needed of some of these various fluids, a nozzle 32 or 75, with switch 72 or 77 that electronically communicates with the controller is used in a preferred embodiment so as to allow the customer to activate the controller 40 to activate flow to the nozzle and shut off by any of several type switching means. A preferred embodiment of the switching means is a spring loaded switch that remains closed only by pressure applied by the customer 72 or 77, FIG. 7 and FIG. 8. Such nozzle 32 or 75 can include a customer display 76 for convenience in monitoring dispensed amounts and cost, along with the usual displays on panel 11, FIG. 1, and on the operator console 45. A further option is a nozzle with switch lever 78 used to activate switch 77. Still another option is to dispense thru nozzle 38, FIG. 11, with a manual cut off valve. Storage tanks for these various automotive fluids are indicated by number 20 in FIG. 1.

A pressuring and flow measuring means is indicated by number 22, FIG. 1. As previously discussed, many types of equipment would be suitable for these functions. A preferred embodiment would be a metering pump 22, FIG. 1, having electronic communication with the controller 40, thereby allowing the controller to activate the metering pump, determine amount dispensed and calculate cost and dollar amount and display the results on panel 11, and/or nozzle display 76. In some embodiments controller 40 also interacts with the operator console 45 to alloW an operator to display costs and amounts in order to properly charge the customer. More particularly communication between controller 40, pressuring and flow measuring means 22 in lines from each storage tank 20, FIG. 1 for other automotive fluids, switches of group 10, and switches 72 and 77 of the dispensing nozzles, and operator console 45 in some embodiments, allows a customer to choose an amount or dispense an amount needed with control at a nozzle switch with display on both panel 11 and optional panel 76 on the nozzle of amount and cost of the amount of fluid from the other automotive fluid group dispensed.

Also in FIG. 4 we show in dotted lines communication between 42, which is present electronic control equipment normally found in a Service Stations, and operator console 45 and controller 40 to indicate that functions of 40 and 45 may be partially or totally integrated into present equipment with modifications. Explanation of FIG. 4 defines the heart of the system. The system we have described is conceived to be built in segments, with varying complexities in each segment. For example:

a first segment could allow a customer to choose one of a group of fuel additives and dispense that using one manual nozzle with display of cost and amounts on a console located near the gasoline pumps. Increasing complexity as described could be added, or supplied originally; or a simple system to allow the customer to pick one of a group of oils or one of a group of additives could be used; or a simple system to allow a customer to select one of any of a group of automotive fluid could be initially installed. We wish to include from this simplest to most complex within the spirit and purpose of the invention.

In FIG. 5 we show one preferred type of fuel blending nozzle. When using this type nozzle, a fuel flowmeter 56 that electronically communicates with the controller 40, FIGS. 1 and 4, is installed in an inlet end of a fuel line leading to fuel nozzle 28. The standard flowmeter 89 in the fuel dispenser may be used instead of the special flowmeter 56 in some embodiments. Additive fuel lines 33 may be bundled to lead to the fuel inlet and then separated and fastened to the nozzle inlet fuel line with a lapped and bonded, or heat shrunk elastic shroud 50 in order to allow free movement of the fuel inlet line and of fuel additive lines 33, or the lines may be made integral with the fuel hose. In this embodiment the fuel additive lines 33 are headered together in a manifold 52 around the fuel hose and terminate in chamber 51 of the manifold 52. Each of the fuel additive lines 33 have some type of check valve such as a flapper valve or ball check valve or a slitted elastic cap to prevent back flow from pressure within chamber 51 into lines not having a positive flow. In a preferred embodiment, the lines 33 are closed with a slitted elastic cap 53 to act as a check valve. A single delivery tube 55 which may conveniently be made of metal tubing and connected with flexible tubing leads from chamber 51 to terminate inside fuel nozzle 28 at a point downstream the hand operated valve 54 in the nozzle where back pressure is always low. Activation of pressuring and flow measuring means, such as a metering pump, for each of the chosen fuel additives is directed by controller 40, FIG. 1, so that the chosen fuel additives are made to flow in their respective lines 33 only after communication from fuel flowmeter 56 to the controller 40 indicates which and how much fuel is flowing, and the additive flows are controlled to be in correct proportion with the measured fuel flow. Inclusion of all the fuel additive lines 33 as an integral part of the fuel hose and nozzle, and interaction of a fuel flow measuring means 89 such as that already in the gas pump, with controller 40 to eliminate the fuel flow measuring device 56 would be within the spirit and purpose of this invention.

FIG. 6 shows a way to insert a conventional fuel nozzle 65 within a blending device 60 to achieve fuel and fuel additive blending with a single flow meter and additive line bundle. This eliminates the need for the automated distributor valve 27, separate additive lines to each fuel nozzle, and the special flow meter in each fueling line. In this case, fuel additive lines 33 along with a meter signal wire from fuel flow meter 61 to the controller 40, FIG. 1, are bundled together in shroud 17. Fuel additive lines 33 may terminate in an internal chamber with a single outlet line tying into the discharge nozzle of blending device 60, or in another embodiment each of the fuel additive lines 33 could tie directly into the discharge nozzle of the blending device 60. The controller interacts with additive pressuring and flow measuring means 26, fuel flow measuring means 61 and with the operator console 45 as previously described to dispense and blend the selected additives in the selected amounts, and to allow display of cost and amount of each additive on housing 1 and display cost and amount on the operator console to facilitate proper payment for the customer.

Figure 10:
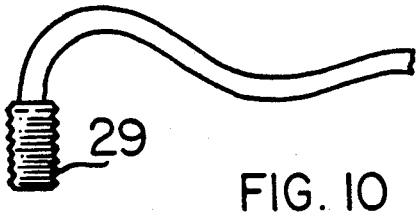
FIG. 10 shows the end of a recoilable fuel additive line that may plug into a standard fuel dispensing nozzle modified with a plug-in port as in FIG. 6 so that a normally closed valve that automatically opens when plugged into the plug-in port allows manually plugging in of the line from the chosen additive to the nozzle thus eliminating the distributor valve and simplifying the installation of additive lines.

Also in FIG. 6 we show an optional normally closed plug-in port 66 on a fueling nozzle 65 to allow manually plugging in a special plug-in to open valve 29, FIG. 10 installed on individual additive lines. With use of plug-in port 66 and additive plug valve 29, the blending unit 60 would not be used. However, simultaneous flow of additive and fuel provides blending of the fuel and additive flows which could either be to a mix ratio controlled by controller 40 and flowmeters 56 or 89, or in a simpler mode where a preselected amount of additive is dispensed by the controller to independent of fuel flow.

Figure 7:
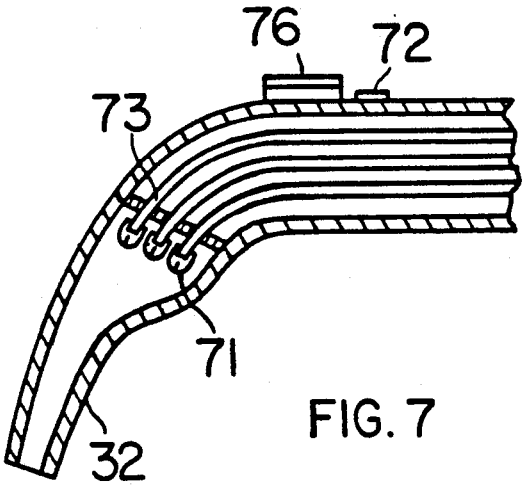
FIG. 7 shows a nozzle specifically designed for dispensing oil and oil additives with a switch to communicate with the controller for activation of the dispensing and measuring system for the customer chosen oil, or oil additive, or oil and oil additive to be blended as dispensed.

FIG. 7 shows a specially designed combination oil and oil additive type nozzle 32 wherein oil and oil additive lines are bundled together and go thru a manifolding device such as pressure tight tube sheet 73 inside the handle of nozzle 32 and each terminate in a slitted plastic cap 71 to act as a backflow check valve. Nozzle 32 can also be used for multiple fuel additives. Switch 72 communicates with controller 40, FIG. 1. Switch 72 is spring loaded open in a preferred embodiment. Switch 72 allows dispensation of an amount of oil and oil additive, or multiple fuel additives, to be dispensed in an unspecified amount as needed, with cost and amount displayed on housing 1 and on customer display 76 that communicates with controller 40 to display dispensed amounts. In some embodiments customer display 76 may not be used.

In FIG. 8 we show a display type nozzle 75 that might be used for dispensing any of the individual oils, oil additives, and other automotive fluids. It incorporates switch 77 and optionally a display screen 76, both of which communicate with controller 40, FIG. 1 as well as with pressuring and flow measuring means 22 thru controller 40 when used for dispensing the various automotive fluids discussed. FIG. 9 shows a side view of nozzle 75. This view indicates one preferred shape of the outlet nozzle to facilitate dispensing the various additives already discussed, such as anti-freeze solution, windshield wiper fluid, etc. In a preferred embodiment a hand valve opening type lever 78 would activate switch 77. Switch 77 and optional display 76 communicate with controller 40, FIG. 1 which activates pressuring and flow measuring means as discussed with activation of switch 77.

In FIG. 10 we show schematically a valve on the end of a recoilable additive line that automatically opens when plugged into a plug-in port. This is similar to the type plug-in to open valve normally used to connect an auxiliary fuel tank on a marine outboard motor. We show such a plug-in port 66 in dispensing nozzle 65 shown in FIG. 6. In a simplified embodiment this manual method of connecting to a fuel nozzle allows blending additives to fuels with simplification of the additive line system, and elimination of the automated distributor valve. If a preselected amount of additive is to be dispensed, instead of a mix ratio, the fuel flowmeter is also eliminated.

Figure 11:
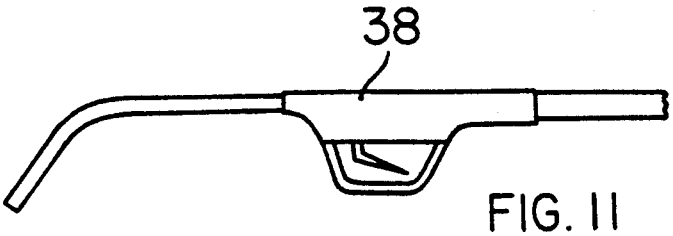
FIG. 11 shows a lever activated valve to be used putting additives directly into a tank or container.

In FIG. 11 we show a side view of a lever activated valve 38 for a single additive or other automotive fluid and is designed for a simple system wherein a switch on housing 1 enables dispensation and the customer manually controls additive addition directly to a tank or container. Such nozzle and valve can be used with pressuring and flow measuring means that are not positive displacement, or that have pressure relief capabilities.

Figure 12:
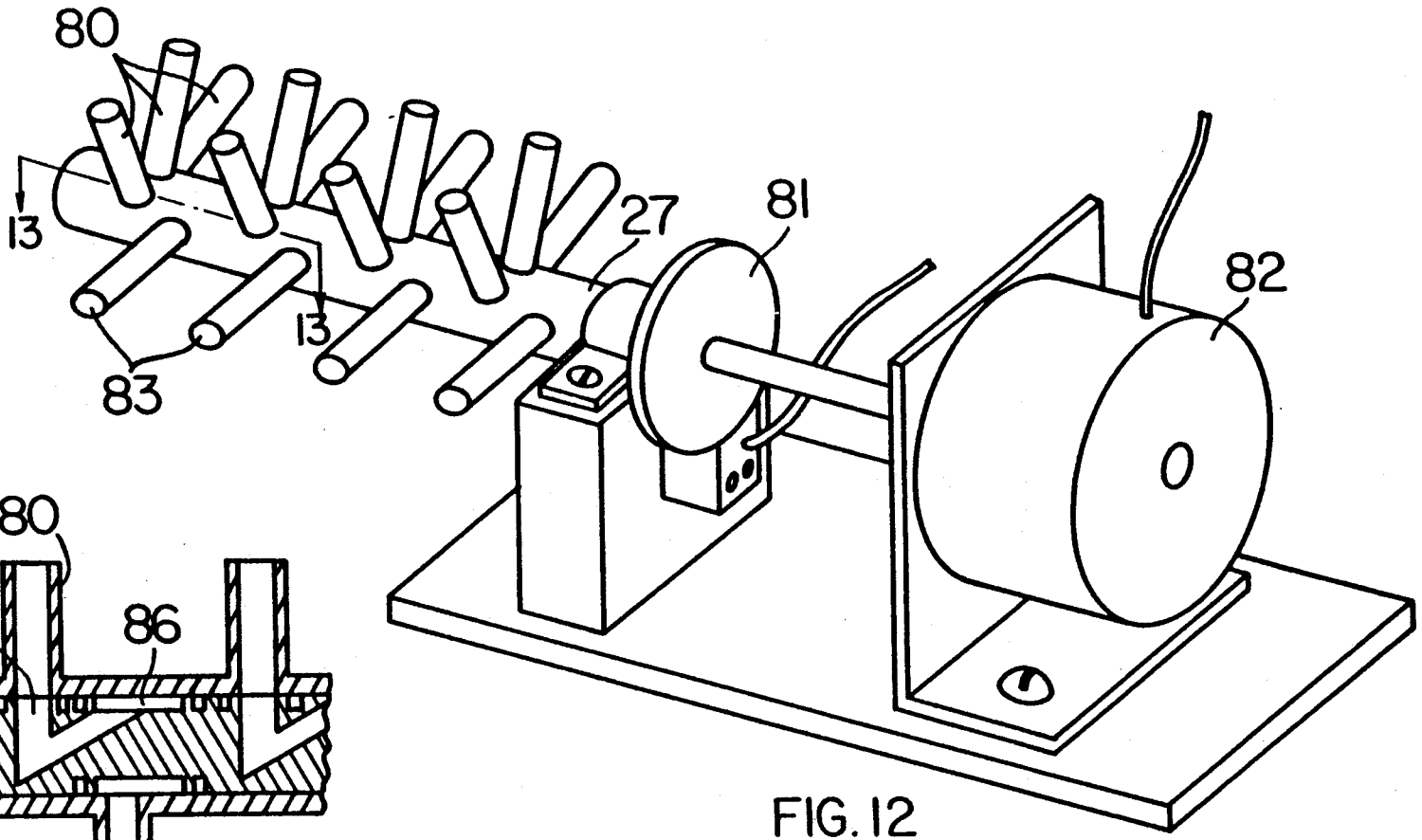
FIG. 12 shows a distributor valve to put one or more of various additives to a chosen outlet line with line choice and positioning directed by the electronic controller.
Figure 13:
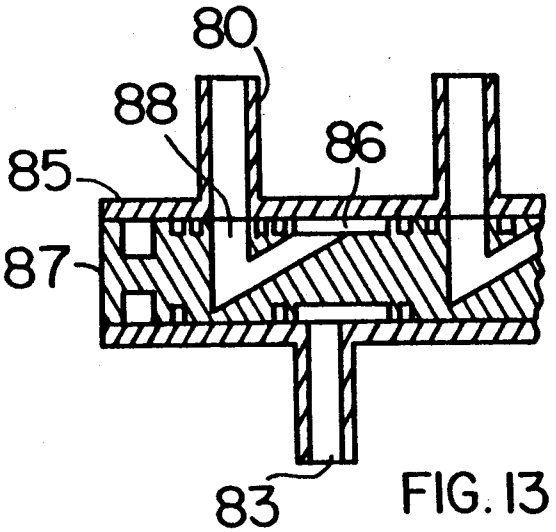
FIG. 13 shows a detail indicating flow path in the distributor valve.

In FIG. 12 we show an additive distributor valve 27 with inlet lines 83 leading from pressuring and flow measuring devices 26 in each of the various fuel additives lines from storage 25. Exit lines nipples 80 provide attachment to lines 33 leading to one of the multiplicity of fuel dispensing nozzles 28, FIGS. 2 and 5 or non-blending nozzle 32, FIG. 2. It can be seen in FIG. 12, the design provides for alignment, by means of internal porting, of the inlets 83 from each of the additive pressuring and measuring means with different outlet nipples 80 at discrete angular positions of the rotor. At each of the different angular positions, all additive inlets are aligned according to schematic FIG. 2, with the group of outlet nipples that direct additive flow to a selected fueling nozzle 28, or to a non-blending nozzle 32. The particular fuel dispensing nozzle 28 and corresponding fuel additive nipples 80 and lines 33 is chosen by controller 40 which receives input from the customer selection of switches 4; fuel flowmeters 56 or 89, and from a valve position sensor 81, and controls the positioning motor 82 of this distributor valve 27 causing the valve to position itself to direct flow of the selected additives to the selected fueling nozzle 28, or to the non-blending nozzle 32. Note that construction of this distributor valve 27 is such that an extension would allow more input lines and more exit lines. FIG. 13 shows a detail of construction of this distributor valve showing stationary housing 85, an internal, ported rotatable shaft 87 having a peripheral chamber 86 communicating with its respective inlet line 83 with sealing rings for each chamber. Outlet port 88 continues to lead to chamber 86 when shaft 87 is rotated. The exit of outlet port 88 leads to individual exit nipples 80 leading from the stationary housing 85 at discrete angular locations in the housing. This enables the distribution of fluids entering from lines 83 to be discharged thru selected nipples 80 by angularly indexing the internal shaft 87 to their respective angular locations in the housing. In this embodiment such angular positioning is accomplished by controller 40 by driving positioning motor 82 and in communication with fuel flow meter 56 or 89, valve position sensor 81, and control switch group 4 of dispenser housing 1.

Many minor mechanical and electronic control changes may be visualized by one of normal skill in the art so that we do not wish to be limited to exact details but only as to the general spirit and purpose of this system as outlined in these claims and specifications.

I claim:

1. An automotive fluids dispensing system comprising:

a) storage means for a multiplicity of different fuel additives, pressuring and flow measuring means in lines from said storage means of each of said multiplicity of different fuel additives, leading through a routing and distribution means to a plurality of first fuel dispensing nozzle means;

b) a fuel flowmeter means in each fuel line leading to said plurality of first fuel nozzle means; and a first switching means to allow choice of each of said multiplicity of different fuel additives to be added into one of said plurality of first fuel nozzle means and to choose a mix ratio of said additives to be added to said fuel nozzle means in terms of a percent of an established normal mix ratio;

c) a controller means, receiving electronic input data from said fuel flowmeter means, said pressuring and flow measuring means, said routing and distribution means, and said first switching means; said controller means reacting from said electronic input data to:

1) direct additive flow of a minimum of one of said multiplicity of different fuel additives to one of said plurality of first fuel nozzle means that is in use;

2) control amount of each of said multiplicity of fuel additives dispensed, 3) calculate, store and display cost and amount of each of said multiplicity of fuel additives dispensed.

2. An automotive fluids dispensing system as in claim 1 where each of said plurality of first fuel nozzle means includes a means to blend said fuel and a minimum of one of said multiplicity of fuel additives.

3. An automotive fluids dispensing system as in claim 2 wherein said means to blend said fuel and a minimum of one of said multiplicity of fuel additives is a normally closed plug-in port in said first fuel nozzle means that reacts with a plug-in-to open valve in exit ends of extensible lines leading from each of said additive pressuring and flow measuring means in lines from said storage means.

4. An automotive fluids dispensing system as in claim 1 wherein each of said first fuel nozzle means comprises a fuel flowmeter in an upstream location in a line leading to said first fuel nozzle means and a multiplicity of fuel additive delivery lines with terminal ends of said fuel additive delivery lines headered together in a common chamber and with an outlet line from said common chamber leading into said first fuel nozzle means.

5. An automotive fluids dispensing system as in claim 1 wherein routing and distribution means includes a moveable nozzle extension, useable with any one of said plurality of first fuel nozzle means, having therein a fuel flowmeter, and terminal ends of lines from each of said multiplicity of fuel additives pressuring and measuring means, and a meter signal wire communicating with said controller, acts as a blending device.

6. An automotive fluids dispensing system as in claim 1 wherein said first switching means includes switches to choose an amount in volumetric measure.

7. An automotive fluids dispensing system as in claim 1 further comprising an operator console means that communicates with said controller means, said operator console means acting on command to display cost and amount each of said multiplicity of fuel additives dispensed and on command activating said controller means to first enable, and then to limit amount of each of said multiplicity of fuel additives dispensed.

8. An automotive fluids dispensing system as in claim 7 wherein functions of said operator console means may be integrated with other electronic control, display and electronic sales transaction equipment.

9. An automotive fluids dispensing system as in claim 1 wherein functions of said controller means may be integrated with dispensing and computer control and display means normally found in a service station fuel dispenser.

10. An automotive fluids dispensing system as in claim 7 wherein said operator console means further acts on command to direct said controller means to limit amount of said fuel dispensed and to display cost and amounts of said fuel dispensed.

11. An automotive fluids dispensing system as in claim 7 wherein said operator console means, on command, prints out said cost and amount of each of said multiplicity of fuel additives dispensed.

12. An automotive fluids dispensing system as in claim 7 where said operator console means, on command, prints out said cost and amount of said fuel dispensed, and said cost and amount of each of said multiplicity of fuel additives dispensed, and accumulates sales data in totalizers for subsequent display, printout and electronic transmission.

13. An automotive fluids dispensing system as in claim 1 further comprising:

a) storage means for storage of a multiplicity of differing oils of different brands and characteristics with oil pressuring means and oil flowmeter means for each of said multiplicity of differing oils, all with lines leading to an oil dispensing nozzle means to allow dispensing each of said multiplicity of differing oils of different brands and characteristics as desired;

b) a second switching means to choose one of said multiplicity of differing oils of different brands and characteristics to be dispensed;

c) electronic input data from said second switching means, said oil pressuring means and said oil flowmeter means, to said controller means; said controller means reacting from said electronic input data to control flow of oil to the said oil dispensing nozzle and calculate and display cost and amount of said multiplicity of different oils dispensed.

14. An automotive fluids dispensing system as in claim 13 wherein said display of cost and amount of said multiplicity of different oils dispensed is located on a housing for said second switching means.

15. An automotive fluids dispensing system as in claim 13 wherein said display of cost and amount of each of said multiplicity of different oils dispensed is located as a display panel on said oil dispensing nozzle means.

16. An automotive fluids dispensing system as in claim 13 further comprising an operator control console that communicates with said controller and, on command, enables and limits dispensing, and displays cost and amount data for each of said multiplicity of differing oils dispensed.

17. An automotive fluids dispensing system as in claim 1 further comprising:

a) storage means for a multiplicity of different oil additives with oil additive pressuring means and oil additive flow measuring means for each of said multiplicity of different oil additives, all with lines leading to an oil dispensing nozzle means;

b) a third switching means to choose one of said multiplicity of different oil additives to be dispensed;

c) electronic input data from said third switching means, said oil additive pressuring means, and said oil additive flow measuring means to said controller means; said controller means reacting to:

1) direct flow of one of said multiplicity of different oil additives chosen to said oil additive dispensing nozzle means; and 2) to calculate and display cost and amount of each of said multiplicity of oil additives dispensed.

18. An automotive fluids dispensing system comprising:

a) a first storage means for a multiplicity of differing oils and a second storage means for a multiplicity of oil additives;

b) pressuring means and flow measuring means in each line leading from said first storage means and said second storage means;

c) lines leading from said flow measuring means to one of a multiple of dispensing nozzle means;

d) a controller communicating with said pressuring means, said flow measuring means and a group of switch means to allow choice of said multiplicity of differing oils and of said multiplicity of oil additives to be dispensed; said controller means acting to control oil and oil additive flow and to display cost and amount of each of said multiplicity of differing oils and cost and amount of each of said multiplicity of oil additives dispensed.

19. An automotive fluids dispensing system as in claim 18 further comprising an operator console means that communicates with said controller means and, on command, controls amounts dispensed of said multiplicity of differing oils and said multiplicity of oil additives and displays cost and amount data for each of said multiplicity of differing oils and each of said multiplicity of oil additives.

20. An automotive fluids dispensing system as in claim 19 wherein said operator console means further acts on command to enable dispensing and to limit amount of each of said multiplicity of differing oils dispensed and to limit amount of each of said different oil additives dispensed.

21. An automotive fluids dispensing system as in claim 1 further comprising:

a) separate storage means for each of a group of automotive fluids, said group comprising fluids such as power steering fluid, engine oil, transmission fluid, transmission fluid additives, windshield wiper fluid, antifreeze coolant solutions, brake fluid, and fuel additives;

b) pressuring means and flow measuring means in output lines from each of said separate storage means, said output lines leading to a dispensing nozzle means; said controller means communicating with said pressuring means and said flow measuring means;

c) a selector switch means to allow customer choice of desired ones of said group of automotive fluids;

d) a switch means in said dispensing nozzle means communicating with said controller means, with electronic input from said switch means, said selector switch means, and said flow measuring means allowing said controller means to act to control flow and to calculate and display cost and volume dispensed of each of said group of automotive fluids.

22. An automotive fluids dispensing system as in claim 21 wherein said controller means communicates with an operator console means that acts, on command, to enable and to limit amount dispensed of any one of said group of automotive fluids and further acts, on command, to display cost and amount dispensed on said operator console.

23. An automotive fluids dispensing system as in claim 21 wherein said dispensing nozzle means includes a display panel to display cost and amount dispensed of a selected one of said group of automotive fluids.

24. An automotive fluids dispensing system as in claim 21 wherein said selector switch means includes switches to authorize said controller to activate said pressuring means and said flow measuring means and further includes switches to choose a volumetric amount to be dispensed of one of said group of automotive fluids.

25. An automotive fluids dispensing system as in claim 1 wherein said controller means also controls dispensing and display of fuel dispensed.

26. An automotive fluids dispensing system comprising:

a) a housing;

b) a controller means and switch means in said housing;

c) a multiplicity of storage tanks for a group of automotive fluids comprising fuel additives, oil, oil additives, windshield wiper fluid, brake fluid, antifreeze/water solution, power steering fluid, and distilled water with pressuring and measuring means in a line leading from each of said multiplicity of storage tanks to an extensible line leading to a manually operated dispensing nozzle; said pressuring and measuring means being activated by said controller means after a customer has activated one or more switches of said switch means to choose one of said group of automotive fluids and an amount of one of said group of automotive fluids to be dispensed; said switch means further including switches to allow a customer to choose an unlimited amount to be dispensed of each of said group of automotive fluids; and d) a display panel of said housing that communicates with said controller to display cost and amount dispensed of each of said group of fluids.

27. A method of dispensing automotive fluids comprising:

a) storing in various storage means a multiplicity of different fuel additives, pressuring and flow measuring means in lines from said various storage means of each of said multiplicity of different fuel additives, leading through a 5 routing and distribution means to a plurality of first fuel dispensing nozzle means with a fuel flowmeter means in each line leading to said plurality of first fuel nozzle means;

b) activating a first switching means to allow choice of each of said multiplicity of different fuel additives to be added into one of said plurality of first fuel nozzle means with said first switching means also allowing choice of an amount of said fuel additive in terms of a percent of an established normal mix ratio; electronic input data from said fuel flowmeter means, said pressuring and flow measuring means, and said first switching means interacting with a controller means; said controller means reacting from said electronic input data to:

1) direct additive flow of a minimum of one of said multiplicity of different fuel additives to one of said plurality of first fuel nozzle means;

2) control amount of each of said multiplicity of fuel additives dispensed, 3) calculate store, and display cost and amount of each of said multiplicity of fuel additives dispensed.

28. A method of dispensing automotive fluids as in claim 27 wherein each of said plurality of first fuel nozzle means includes a means to blend said fuel and a minimum of one of said multiplicity of fuel additives.

29. A method of dispensing automotive fluids as in claim 28 wherein each of said first fuel nozzle means comprises a fuel flowmeter in a beginning end of a hose leading to said first fuel nozzle means and a multiplicity of fuel additive delivery lines with terminal ends of said fuel additive delivery lines headered together in a common chamber and with an outlet line from said common chamber leading into said first fuel nozzle means downstream of a fuel cut off valve.

30. A method of dispensing automotive fluids as in claim 29 further comprising an operator console means that communicates with said controller means, said operator console means acting on command to display cost and amount each of said multiplicity of fuel additives dispensed and on command activating said controller means to first enable, and then to limit amount of each of said multiplicity of fuel additives dispensed.

31. A method of dispensing automotive fluids as in claim 30 wherein functions of said operator console means and said controller means may be integrated with electronic control and display means normally found in a service station.

32. An automotive fluids dispensing system as in claim 4 wherein each of said terminal ends of said fuel additive delivery lines is connected to deliver said fuel additive into said first fuel nozzle means down stream of said fuel cut off valve.

33. An automotive fluids dispensing system as in claim 5 wherein output signals of conventionally installed flowmeters in a normal service station are used by said controller means to control amount of each of said multiplicity of fuel additives dispensed.

34. An automotive fluids dispensing system as in claim 26 wherein said controller means also controls dispensing, and display of fuel dispensed.

35. An automotive fluids dispensing system as in claim 34 further comprising an operator console means that communicates with said controller means to display cost and amount of each of said multiplicity of fuel additives and fuels dispensed and upon command activating said controller means to first enable, and then to limit amount of each of said multiplicity of fuel additives and fuel dispensed.

36. An automotive fluids dispensing system as in claim 1 wherein output signals of conventionally installed fuel flowmeters in a normal service station are used by said controller means to control amount of each of said multiplicity of fuel additives dispensed.

* * * * *

UNITED STATES PATENT AND TRADEMARK OFFICE

CERTIFICATE OF CORRECTION

PATENT NO. : 5,018,645

DATED : May 28, 1991

INVENTOR(S) : Herbert G. Zinsmeyer

It is certified that error appears in the above-identified patent and that said Letters Patent is hereby corrected as shown below:

In patent 5,018,645, Column 2, Line 66, please delete "Valle" and insert --Valk--;

Under references cited, the patent numbers 3,316,844 and 4,276,997 and 4,596,277 and 4,714,087 in In Column 7, Line 43, please delete "38" and insert --32-- and in column 7, line 52, please delete "38" and insert --32--;

Column 10, line 5, after the word "through" please delete --a--;

Column 12, line 13, please delete the word "to".

Signed and Sealed this

Twenty-third Day of June, 1992

*Attest:*

DOUGLAS B. COMER

*Attesting Officer*

*Acting Commissioner of Patents and Trademarks*